US005743051A

United States Patent [19]

Bergmann

[11] Patent Number: 5,743,051

[45] Date of Patent: Apr. 28, 1998

[54] PRESENTATION SYSTEM

[76] Inventor: Wolfgang Bergmann, Gerokstrasse 14, D-70734 Fellbach, Germany

[21] Appl. No.: 709,750

[22] Filed: Sep. 9, 1996

[30] Foreign Application Priority Data

Sep. 12, 1995 [DE] Germany ..... 195 33 619.4

[51] Int. Cl.[6] ..... E04B 2/76

[52] U.S. Cl. ..... 52/27; 40/605; 211/189; 248/309.1

[58] Field of Search ..... 52/36.4, 36.1, 52/27; 211/87, 189; 248/300, 309.1; 40/605, 606, 733

[56] References Cited

U.S. PATENT DOCUMENTS

| | | | |
|---|---|---|---|
| 3,537,687 | 11/1970 | Adelman . | |
| 3,886,676 | 6/1975 | Alfonso | 40/605 |
| 4,043,086 | 8/1977 | Kaulfuss et al. | 52/36.4 |
| 4,263,739 | 4/1981 | Lee . | |
| 5,414,971 | 5/1995 | Handte . | |

FOREIGN PATENT DOCUMENTS

| | | | |
|---|---|---|---|
| 588 187 | 3/1994 | European Pat. Off. . | |
| 1251138 | 12/1960 | France | 40/606 |
| 7515104 | 11/1975 | Germany . | |
| 2651486 | 5/1978 | Germany . | |
| 2737497 | 3/1979 | Germany . | |
| 8704142 | 3/1987 | Germany . | |
| 42 11 853 | 10/1993 | Germany . | |
| 9420454 | 12/1994 | Germany . | |
| 94 20 454.3 | 2/1995 | Germany . | |

*Primary Examiner*—Wynn E. Wood
*Assistant Examiner*—Timothy B. Kang
*Attorney, Agent, or Firm*—Quarles & Brady

[57] ABSTRACT

A presentation system is built up from individual presentation devices, which are in each case formed by a plate element, which is fixed to at least one and preferably two parallel section rails. The section rails are L-shaped and engage with their forwardly directed horizontal legs through a correspondingly shaped horizontal slit in the plate element. In this position they are screwed to the plate element. The profile section leg projecting forwards through the slit is used for fitting holders, fastenings, etc. The plate elements are interconnected at the ends of the section rails, e.g. by threaded bolts passing through bushes. A universal arrangement is possible.

16 Claims, 3 Drawing Sheets

PRESENTATION SYSTEM

BACKGROUND OF THE INVENTION

1. Field of the Invention

The invention relates to a presentation system.

2. Description of Related Art

For the presentation, display and exhibiting of objects, posters, advertising media, etc. numerous possibilities are available. Show cases exist, which can be hung in fixed manner on a wall. Blackboards to which posters can be stuck are also known.

SUMMARY OF THE INVENTION

The object of the invention is to create a simply constructed and universally usable presentation system, which can be adapted with simple means to the most varied requirements.

For achieving this problem the invention proposes a presentation system comprising: a presentation system, comprising: a substantially rectangular plate element with vertical lateral edges and a depression; at least one section rail running transversely between the vertical lateral edges of the plate element; the at least one section rail having a vertical flange fixed to the plate element and having a bearing element, for example a hinge element, on each of its two ends; and, at least one section rail having a horizontal flange engaging in the depression from the back of the plate element. Advantageously, the depression is a slit through the plate element, the slit having a width corresponding to the thickness of the horizontal leg horizontal leg of the at least one section rail can projects through the slit and beyond the front of the plate element.

The presentation system proposed by the invention is built up from a plate-like element, which is fitted to a rail equipped with support or bearing means. The plate element can be any random plate-like material having a certain inherent stability. To the front of said plate element can be fitted flat articles or objects. It is also possible to fit non-flat articles to the front surface with the aid of hooks or the like. The plate-like element is fixed, e.g. screwed to the profile, section or shaped rail. With the aid of the bearing elements the section rail can e.g. be hung on wall hooks or posts. It is obviously also possible with the aid of bearing elements to interconnect several such section rails, e.g. in the form of a closed polygon or also in zig-zag form. The plate-like elements can stand on the ground, so that no additional posts are needed.

The plate-like elements can be made from the most varied materials, which can be matched to the particular presentation function. It is conceivable to use a plate-like element made from transparent material, so that articles which are not to be handled by the observer can be fitted to the back.

The shape and size of the section rails are adapted to the shape of the plate elements. The plate elements can in particular be planar panels, but can also be convexly or concavely curved elements with correspondingly shaped section rails.

In the normal case the section rails run horizontally, i.e. at right angles to the vertical lateral edges of the plate elements. However, it is also possible for the section rail to slope slightly to the lateral edges of the plate element.

For a particularly stable and reliable fixing the plate element can engage flat with its back surface on the vertical flange of the section rail to which it is fixed.

Fixing can in particular be chosen in such a way that an easy release is possible, so that the plate elements can also be easily replaced.

According to a further development of the invention, the section rail can have a horizontal flange extending forwards from the vertical mounting flange and which engages in a depression emanating from the back of the plate element. The depression can e.g. be a groove, whose width and depth are adapted to the horizontal flange. In this way there is a fixing between the plate element and section rail in the vertical direction of a particularly stable nature, so that no loosening phenomena occur even after prolonged use. In addition, the engagement of the horizontal flange in the depression can facilitate installation, if e.g. the plate element is screwed with screws from the front to the section rail.

According to a further development, the depression is constructed as a through slit up to the front of the plate element. The slit can optionally be sub-divided in the same way as the horizontal flange.

The horizontal flange of the section rail can be traversed by the slit and can project beyond the front of the plate element. In this case the part of the flange located on the front of the plate element can fulfil further functions, e.g. can have holders or fastenings for the articles to be presented or displayed.

According to a further development of the invention the bearing elements on both ends of the section rail can be arranged and/or constructed in complimentary manner to one another. The complimentary construction and/or arrangement facilitates the assembly of several presentation devices so as to form a presentation system is facilitated in that identical section rails can be used.

In particular, the bearing elements can be constructed as bushes. For example, a bush can be fitted higher at one end of the section rail than at the other end, so that several identical section rails can be lined up and fixed.

According to a further development, the axes of the bushes can be located in the plane of the back of the vertical mounting flange of the section rail. In this case two section rails and therefore two plate elements can be arranged and fixed back to back. Such an arrangement is advantageous when several presentation devices are arranged in zig-zag form, if the arrangement is accessible from both sides and it is not wished to see the section rails.

The bushes can be provided both for hanging up profile or section rails and therefore the plate elements on hooks and posts and also for interconnecting two adjacent plate elements under a specific angle or also in pivotable manner. For the connection of said bushes of two section elements it is e.g. possible to use bolts which, if they are screwed down and secured, also offer security against manipulation attempts.

Whereas in the case of smaller objects, particularly those having a reduced height, a single section rail can be sufficient for a plate element, according to a further development of the invention a plate element is fitted to two parallel section rails, which are in particular identical.

The invention proposes that a presentation system be assembled from a plurality of plate elements provided with section rails. If the plate elements are fixed to two section rails, they have the same spacing throughout. Preferably the section rails also have the same spacing throughout from the lower edge of the plate elements, so that the presentation system can be stood on the ground. It is also possible for certain plate elements within the presentation system not to stand on the ground, or for posts to be used.

DETAILED DESCRIPTION OF THE PREFERRED EMBODIMENTS

Figure 1:
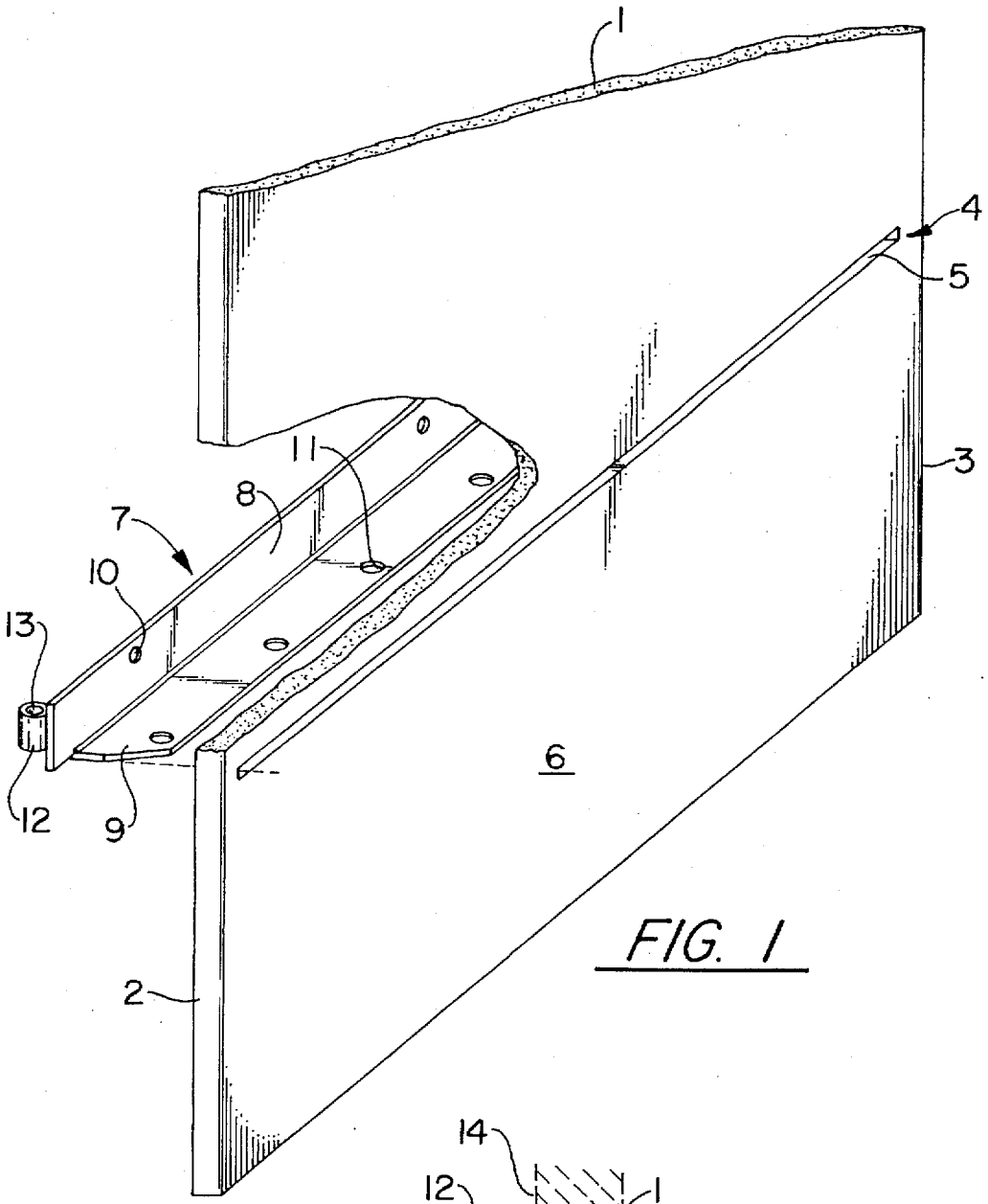
FIG. 1 diagrammatically illustrates the association of a plate element, shown in broken away form, with a section rail.

The basic principle of the presentation device or system can be gathered from FIG. 1. For fitting the articles to be displayed or presented is provided a plate element 1, which is shown in the lower region in FIG. 1. The plate element can be a planar panel, but can also diverge from this shape and can e.g. be curved. The plate element contains two lateral edges 2, 3, which are vertically directed when the presentation system is in use.

In the plate element 1 is formed a depression 4, which is constructed as a slit. The slit 5 passes through from the back to the front 6 of the plate element 1 visible in FIG. 1. Its length extends over virtually the entire width of the plate element, i.e. almost from one lateral edge 2 to almost the other lateral edge 3. The slit 5 could also be interrupted, so that it would comprise several successive and/or juxtaposed slits.

The plate element 1 is fitted to a shaped, profile or section rail 7, which is so positioned that it is connected to the plate element 1 from the back thereof. In cross-section, the section element 7 is shaped like a right-angled section with a vertically directed flange 8 and a horizontal flange 9, extending forwardly at right angles and fitted to the front thereof. The section could also be a T-section. The section is in particular a one-piece section. The thickness of the front, horizontal flange 9 corresponds to the width of the slit 5. The front flange 9 of the section rail 7 is slid through the slit 5 until the front of the mounting flange 8 engages flat on the back of the plate element 1. In this position the plate element is screwed with the aid of screws (not shown) to the mounting flange 8 of the section rail 7. To this end the mounting flange 8 contains a few threaded holes 10.

The width of the horizontal flange 9 is greater than the thickness of the plate element 1, so that in the fitted state the horizontal flange 9 projects over the front of the plate element 1. In the projecting, front portion, the horizontal flange has a row of fixing holes 11, which can be used for fixing further holders, fastenings, etc.

In the vicinity of its two ends in each case one bearing element 12 is fitted, e.g. welded to the section rail 7. The bearing or support element 12 is constructed for the fixing of the section rail 7, e.g. in that it is shoved up onto a wall hook or onto a post. The shoving up direction is from top to bottom, which can e.g. be achieved by a vertically directed hole 13.

Figure 2:
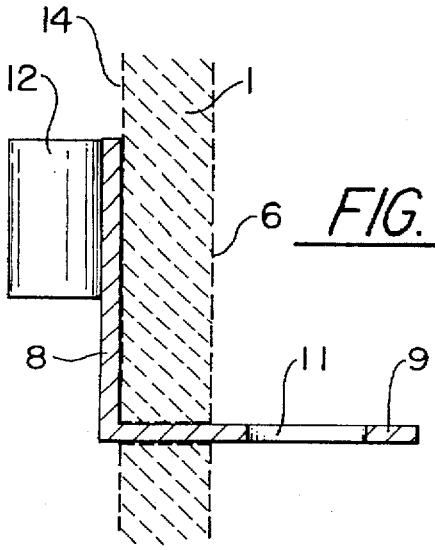
FIG. 2 is a cross-section through the section rail.

FIG. 2 diagrammatically shows the arrangement of the section rail 7 and plate element 1 in the fitted state. The back 14 of the plate element 1 engages on the front of the mounting flange 8. For reasons of simplification, the mounting screws are not shown. The fixing holes 11 are completely in front of the front 6 of the plate element 1. It is also possible to see the bearing element 12, which partly extends beyond the back of the mounting flange 8.

Figure 3:
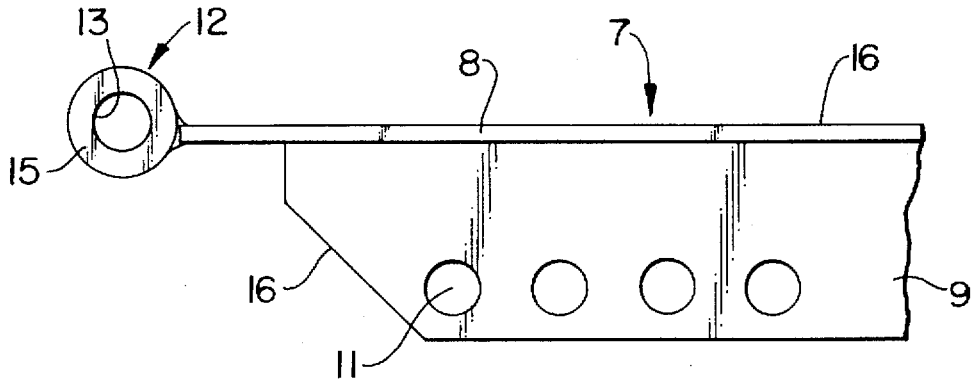
FIG. 3 is a broken away plan view of one end of a section rail.

FIG. 3 is a plan view of one end of the section rail 7. On the end of the mounting flange 8 shown in plan view in FIG. 3 is fitted, e.g. welded the bearing element 12 in the form of a bush 15. The bush 15 with its axial through hole 13 is so fitted that the axis of the hole 13 is in the plane of the back 16 of the mounting flange 8.

The horizontal flange 9 does not extend entirely up to the end of the mounting flange 8 and instead terminates before this. Its length corresponds to the length of the slit 5. In its end region the horizontal flange 9 has a bevel 16 facilitating its insertion in the slit 5.

Figure 4:
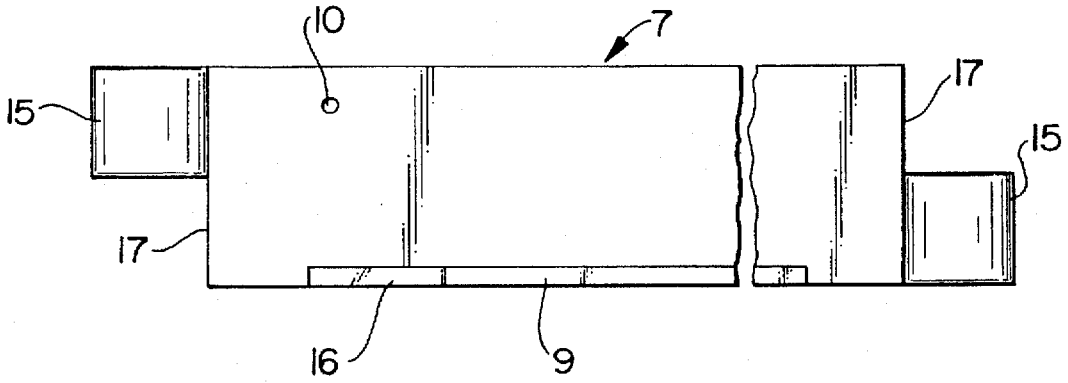
FIG. 4 is a broken away front view of a section rail according to FIG. 3.

FIG. 4 is a front view of the section rail 7 of FIG. 3. It is in particular possible to see that on the left-hand end of the section rail 7 is located the bush 15 in the upper region and its axial length measured from top to bottom is roughly half the width of the mounting flange 8.

Figure 5:
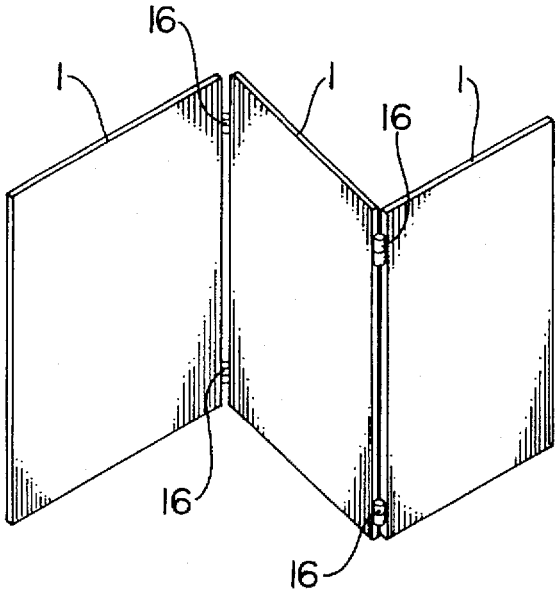
FIG. 5 is a front perspective view of a plurality of interconnected plate elements.

On the opposite, right-hand end the bush 15 is located in the lower half of the lateral edge 17, i.e. complimentary to the arrangement on the left-hand side. This makes it possible to fit on either side of the section rail, the next section rail 7 identically constructed at its fixing end. In this way it is possible to line up several section rails 7, so as to be able to fit several plate elements 1 in a random angular position. For this purpose it is merely necessary to shove together the corresponding ends of the section rail 7 and then a pin or bolt is passed through the openings 13 of the superimposed bushes 15 to form hinges 16, as shown in FIG. 5. It is possible to have both open and closed arrangements, in which the section rails 7 constitute a closed ring.

As a result of the displaced arrangement of the bushes 15, as described in FIG. 3, it is even possible to fit two such identically constructed section rails back to back, so that e.g. two plate elements can be arranged in parallel with one another. This is particularly advantageous if the section rails 7 are to remain invisible.

In the normal case a section rail 7 is fitted not only in the lower region, but also in the top region to a plate element 1, so that each plate element has two parallel section rails. In an arrangement in which the plate elements 1 assume an angle with respect to one another diverging from 180°, this leads to a structure, which is inherently stable.

The plate elements can also be assembled in closed form for forming polygonal columns, e.g. as a triangular or square column. The plate elements need not have the same width and same height.

What is claimed is:

1. A presentation system, comprising:

a substantially rectangular plate element with vertical lateral edges, a front and a back, and a depression in said back;

at least one section rail running transversely between the vertical lateral edges of the plate element;

the at least one section rail having a vertical flange fixed to the plate element and having a bearing element on each of the ends of said at least one section rail; and, the at least one section rail having a horizontal flange engaging in the depression from the back of the plate element.

2. A presentation system according to claim 1, wherein the back of the plate element engages flat on the vertical flange of the at least one section rail.

3. A presentation system according to claim 1, wherein the depression is a slit through the plate element, the slit having a width corresponding to the thickness of the horizontal flange.

4. A presentation system according to claim 3, wherein the horizontal flange of the at least one section rail projects through the slit and beyond the front of the plate element.

5. A presentation according to claim 4, wherein the horizontal flange of the at least one section rail has article fastening means in front of the plate element.

6. A presentation system according to claim 1, wherein the bearing elements on the ends of the at least one section rail are arranged in complimentary manner to one another.

7. A presentation system according to claim 1, wherein the bearing elements comprise bushes.

8. A presentation system according to claim 7, wherein the bushes have axes located in the plane of the back of the vertical mounting flange of the at least one section rail.

9. A presentation system according to claim 7, further comprising at least one of a bolt and a pin capable of passing through bushes of adjacent section rails for connecting the section rails.

10. A presentation system according to claim 1, wherein a second section rail is positioned parallel to the at least one section rail.

11. A presentation system according to claim 1, comprising a plurality of the plate elements, the plurality of plate elements having respective ones of the section rails arranged at the same height and interconnected with at least one other of the plurality of section rails.

12. A presentation system, comprising:

a substantially rectangular plate element with vertical lateral edges, a front and a back, and a depression in said back;

at least one section rail running transversely between the vertical lateral edges of the plate element;

the at least one section rail having a vertical flange fixed to the plate element and having a hinge element on each of the ends of said at least one section rail; and, the at least one section rail having a horizontal flange engaging in the depression from the back of the plate element.

13. A presentation system according to claim 12, comprising a plurality of the plate elements, the plurality of plate elements having respective ones of the section rails arranged at a common height and interconnected with at least one other of the plurality of section rails.

14. A presentation system according to claim 12, further comprising a pin passing through the hinge elements of adjacent section rails for connecting the section rails.

15. A presentation system according to claim 12, wherein the depression is a slit through the plate element, the slit having a width corresponding to the thickness of the horizontal flange.

16. A presentation system according to claim 15, wherein the horizontal flange of the at least one section rail projects through the slit and beyond the front of the plate element.

* * * * *